United States Patent [19]

Simon

[11] Patent Number: 4,664,273

[45] Date of Patent: May 12, 1987

[54] CHILD-RESISTANT CONTAINER WITH RESISTANCE INDICATING MEANS

[76] Inventor: B. Kenneth Simon, 40 Woodhaven Dr., Pittsburgh, Pa. 15228

[21] Appl. No.: 857,638

[22] Filed: Apr. 29, 1986

[51] Int. Cl.[4] ..... B65D 55/02

[52] U.S. Cl. ..... 215/216; 215/203; 215/217; 215/330

[58] Field of Search ..... 215/203, 211, 217, 216, 215/218, 330, 307

[56] References Cited

U.S. PATENT DOCUMENTS

| | | | |
|---|---|---|---|
| 2,423,582 | 7/1947 | Coleman . | |
| 2,684,168 | 7/1954 | McGinnis et al. . | |
| 2,827,193 | 3/1958 | Martin . | |
| 3,185,333 | 5/1965 | Sharp . | |
| 3,741,421 | 6/1973 | Wittwer . | |
| 3,952,899 | 4/1976 | Cooke | 215/217 |
| 4,053,077 | 10/1977 | DeFelice . | |
| 4,099,639 | 7/1978 | Box et al. | 215/216 |
| 4,124,134 | 11/1978 | Montgomery . | |
| 4,270,664 | 6/1981 | Buono | 215/216 |
| 4,289,248 | 9/1981 | Lynn . | |
| 4,413,743 | 11/1983 | Summers | 215/216 |
| 4,461,394 | 7/1984 | Sendel et al. . | |
| 4,534,477 | 8/1985 | Laub . | |

*Primary Examiner*—George T. Hall

*Attorney, Agent, or Firm*—Buell, Ziesenheim, Beck & Alstadt

[57] ABSTRACT

A child-resistant container including in combination a container and a threadedly engaged closure means. The interior of the closure means is provided with compressible sealing means for fluid-tight sealing of the container. The neck of the container is provided with outwardly radial projections and the skirt of the closure is provided with inwardly radial grooves to engage said projections and provide a child resistance means. The closure means has an indicating marker and the marker is visually aligned with a visible feature of the container when the container is both sealed and in the child-resistant mode.

22 Claims, 16 Drawing Figures

CHILD-RESISTANT CONTAINER WITH RESISTANCE INDICATING MEANS

This invention relates to a child-resistant container having marker means to indicate when it is secured in the child-resistant mode. The present invention also relates to a method for closing a child-resistant container so that it is in both a fluid-tight condition and a child-resistant mode and also provides visual evidence of both of these conditions.

The invention relates to a combination structure including a container and a removable rotatable closure means therefore. Upon assembly, the container is sealed and the closure is engaged in a child-resistant position with said sealing and child-resistant engagement being visually indicated during and after assembly of said combination. The container has a tubular neck having a top opening and an exterior helical thread with a plurality of outwardly radial flexible projections or lugs on said neck at a level below said exterior thread. The projections can lie on a horizontal plane or can be arranged along a sloping line corresponding to the slope of the thread. The closure means has a disk-like crown and an integral cylindrical skirt depending therefrom. The closure means skirt has an interior helical thread for functionally engaging the exterior thread on the container. A compressible sealing material is provided inside said crown that cooperates with the opening on the container neck for fluid-tight sealing of said opening when said closure is threadedly tightly engaged thereon.

The skirt of the closure means has interior groove means located at a level below said interior threads for functionally engaging said projections. The groove means is defined by spaced-apart sidewalls extending radially inwardly from said skirt. The projections on the container and the sidewalls on the closure means are shaped to allow the groove means to engage and disengage the projections upon rotation of the closure on said threads in either direction. An enhanced torque is required to enable the groove means to engage and disengage said projections. Preferably, the sidewalls are shaped so that a greater torque is required to disengage than to engage the projections. The combination is adapted so that upon rotating the closure means in a clockwise direction the compressible material contacts the opening to effect a seal, and upon further rotation in a clockwise direction the compressible material is compressed while said groove means engages said projections. Upon said further rotation a marker embossed or otherwise inscribed on the closure means comes into visual alignment with a marker embossed or otherwise inscribed on the container or with any other visible feature on the container, such as a handle, indicating that said combination is both sealed and in the child-resistant mode.

The combination is specifically designed so that the marker on the closure means after reaching a sealing position, as will be apparent upon an increased resistance to rotation, can be rotated further so that the marker on the closure can align with a zone marker on the container indicating (1) the closure means and the container are in fluid-tight engagement and (2) the groove means on the closure engages or has engaged the projections on the container, so that the closure is in a child-resistant mode. This design requires relating the circumferential position of the top end of the exterior thread on the neck of the bottle with the circumferential position of the bottom end of the interior thread on the skirt of the closure means and also with the vertical distance on the neck of the container between the top end of the exterior thread and the top landing of the neck (the S dimension). The positions of the marking on the exterior of the closure means and on the container are both determined by these design relationships so that the closure marker after the closure is in the sealing mode becomes aligned with the container marker when the projections on the container and the grooves on the closure means are in the child-resistance mode.

The closure means marker can be embossed on either the exterior of the skirt of the closure means or on the exterior of the crown of the closure means. If it is embossed on the exterior of the crown, the combination can be arranged so that it can be brought into alignment with some visible feature on the container, such as a handle, rather than a marker on the container.

If desired, the individual grooves on the closure means can be spaced apart by a circumferential distance equal to the circumferential spacing of the corresponding projections on the neck of the container. In this embodiment, as the closure is turned counterclockwise on opening the container, rotation through the child-resistant zone will become progressively less difficult because the plurality of flexible projections which are initially engaged will become progressively disengaged. For example, if there are four adjacent projections on the neck of the container and four adjacent grooves on the closure means and all four projections are initially engaged within the four adjacent grooves on the closure means, counterclockwise rotation will initially be most difficult because it will have to overcome the resistance of all four engaged projections. As the projections are individually disengaged, the counterclockwise rotation becomes progressively easier. When only one projection is engaged, rotation through the child-resistant zone will be the easiest.

The above mode of counterclockwise rotational opening through a child-resistance zone has an inherent disadvantage. If a child manages to muster sufficient strength in a one-time effort, he or she can initiate counterclockwise rotation. After this initial burst of energy, remaining counterclockwise rotation becomes progressively easier. Therefore, the child-resistant mode requires only one maximum effort.

The amount of torque effort to open the closure through the child resistance zone can be established by a testing protocol as determined by federal regulations covering poison prevention packaging. In the mode described above, all the projections taken together must satisfy this protocol so that only one maximal opening effort is required. In the more preferred mode described below, only a portion of the projections must satisfy this protocol at one time, with the remaining portion satisfying this protocol at another time, so that sequential maximal opening efforts are required.

In the preferred embodiment, adjacent projections on the container are circumferentially spaced relatively further apart than are adjacent grooves on the closure means. This arrangement permits only a portion of the projections to be engaged to accomplish the child-resistant mode. In this embodiment, the projections can be relatively larger than in the less preferred embodiment so that one or a portion offer a resistance as great as the resistance offered by all the projections in the less preferred embodiment. In the preferred embodiment, when only one projection is engaged in a groove at one time, the protocol must be satisfied when that projection is disengaged. Therefore, the torque required for disengagement is a maximum for that projection. Upon rotation of the closure, after one projection is disengaged, another becomes engaged. The protocol will then again have to be satisfied to disengage that other projection. The torque required to disengage the second projection will be equally large as the torque required to disengage the first projection. In this manner, a series of individual torques are required for disengagement, each required torque being as great as its predecessor. Thereby, a series of separate and discrete child-resistance zones are provided so that a single effort by a child will not suffice to pass the overall child-resistance zone. Under this arrangement, a series of equally great efforts are required. In the preferred embodiment, a single and fortunate (or unfortunate) effort by a child which the child is not likely to be capable of repeating will not overcome the overall child-resistance zone.

In the preferred arrangement, when the closure is rotated clockwise to accomplish engagement, the grooves initially engage a first projection in a series of projections and during further rotation can disengage the first projection and engage a subsequent projection. A gap can be provided between consecutive projections in which one or more grooves can reside without engaging a projection while an adjacent groove engages a projection. If desired, all grooves can reside between adjacent projections. Upon counterclockwise rotation for disengagement, the subsequent projection is disengaged followed by the engagement of the initial projection. Thereby, the counterclockwise rotation through the child-resistance zone is accomplished by a series of maximum torque forces. This is contrasted to the less preferred embodiment wherein only a single maximum torque force is required.

In terms of method, this invention relates to closing a container using a removable rotatable closure means capable of threaded engagement with the neck of the container with the closure means being provided with a compressible material to form a fluid-tight seal between the closure means and the opening of the container and with the closure means having inwardly radial projection groove means for engaging outwardly radial projection means on the neck of the container. The method includes providing a container marker on the exterior of the container and a closure marker on the exterior of the closure means. The closure means is rotated on the neck of the container in a clockwise direction until the compressible material on the closure means contacts the opening and forms a fluid-tight seal therebetween. The clockwise rotation is continued to compress the sealing means while the groove means engages the projection means and until the closure marker becomes visually aligned with the container marker or with some feature of the container or has passed beyond said visible feature.

When employing the preferred child-resistance structure, the method requires the closure means to be rotated until an initial one of the grooves on the groove means engages an initial one of the projection means. The clockwise rotation is continued until said initial one of the grooves disengages said initial one of the projection means and engages a later one of said projection means, leaving said initial one of said projection means disengaged. The clockwise rotation is not stopped until the closure means marker is visually aligned with the container marker or has been rotated beyond the container marker and said initial one of said projections is disengaged. In another embodiment, the rotation is not stopped until the closure marker is visually aligned with the container marker or has been rotated beyond the container marker and all projections engaged prior to said later projection are disengaged or all projections are disengaged after disengaging said later projection.

During clockwise rotation of the closure means onto the container, the compressible means on the inside of the crown of the closure means first makes contact with the top landing of the neck of the container. At this point, a fluid-tight seal between the container and the closure means is in effect. Sealing occurs prior to or at least coincidently with the engaging of the projections with the groove means. The reason is that prior engagement of the projections could induce a resistance against rotation to accomplish subsequent sealing. In such case, the container would be provided with child-resistance without being fluid-tight. If rotation were terminated at this point, the purpose of the child-resistant feature would be defeated and a dangerous situation would arise in the case of a liquid-holding container because a child could invert the container and spill its contents while its child-resistance feature is engaged. On the other hand, this situation could be acceptable were the container to hold solid tablets instead of a liquid.

After the compressible material on the closure means first makes contact with the landing of the neck of the container and the fluid-tight engagement is made, further rotation of the closure means is possible because of the compressibility of the sealing material. Thereby, the sealing material provides a rotational sealing zone. Engagement between the grooves and projections can occur to effect the child-resistance feature during rotation through the sealing zone.

It will be appreciated that the sealing zone and the child-resistance zone each offer resistance against rotation. Therefore, passage through either of these zones can mask a failure to enter the other of these two zones. Because passage through these zones is not visually evident, the marker alignment means of the invention is provided. The marker alignment means is adapted so that a visual sign is provided in conjunction with the increased resistance to rotation occurring upon sealing when child-resistance has occurred. Absent the visual alignment indication, the masking of the sealing by the child-resistance feature or of the child-resistance feature by the sealing during clockwise rotation of the closure means could result in a highly dangerous situation when the container holds a dangerous liquid.

The present invention will be more completely understood by reference at the attached figures in which.

Figure 5:
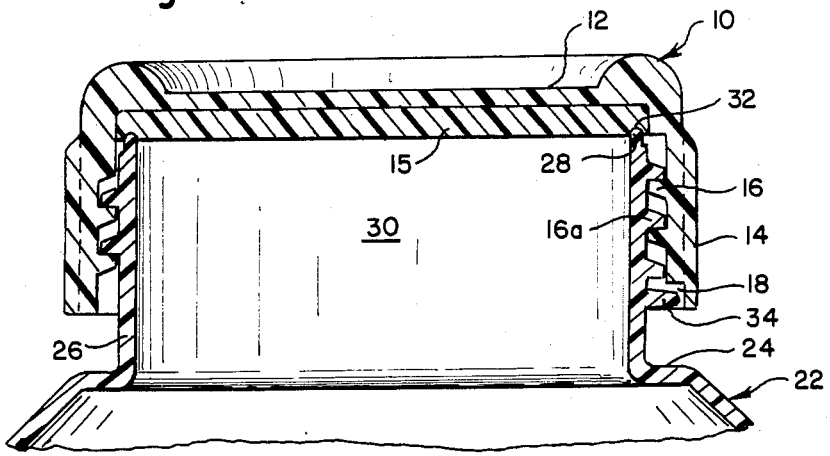
Figure 6:
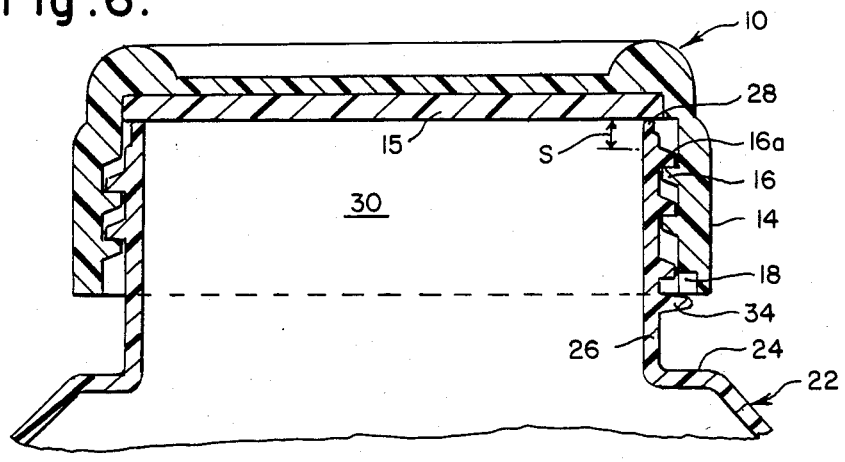
Figure 7:
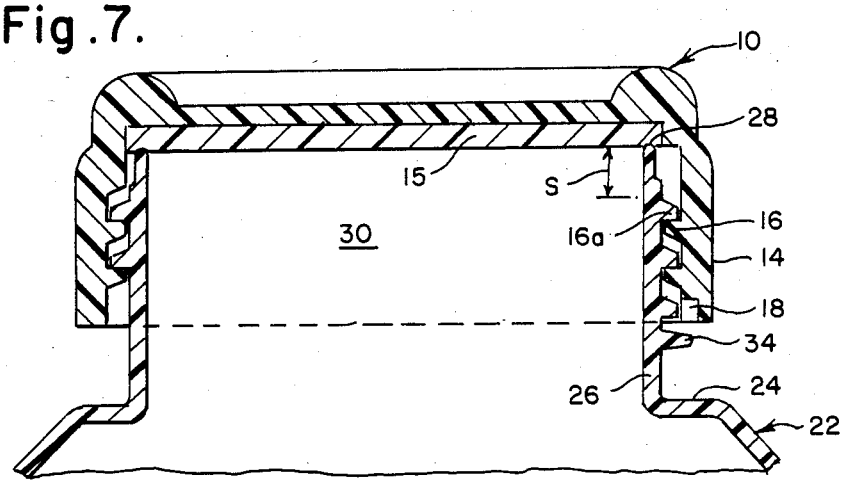
Figure 8:
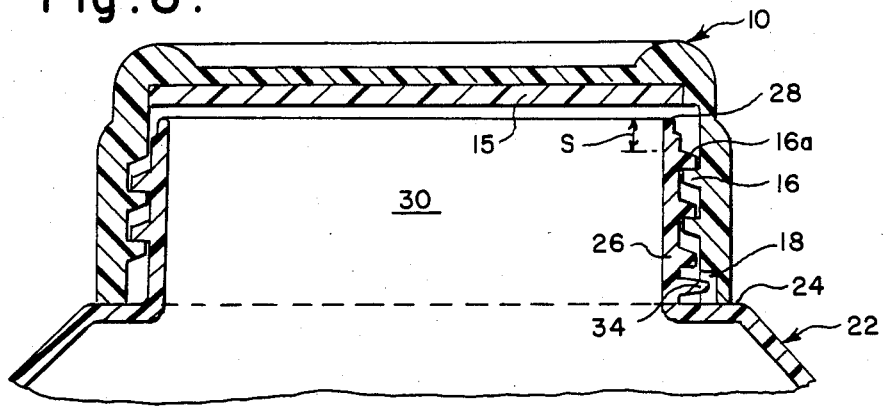
Figure 9:
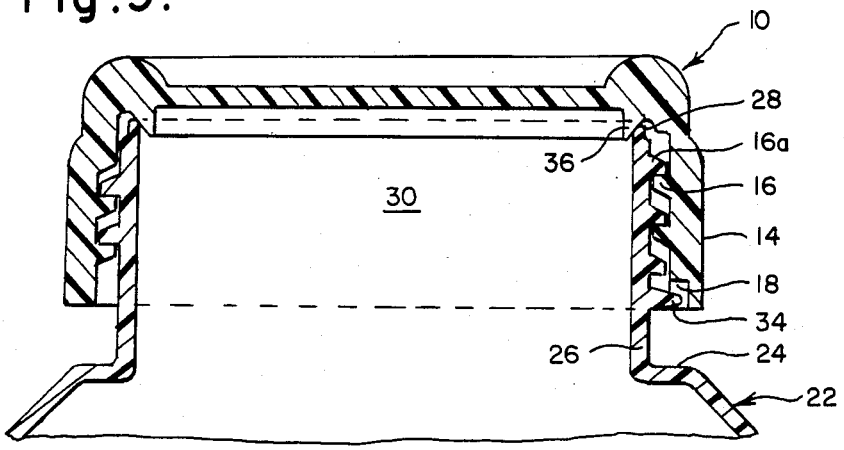
Figure 10:
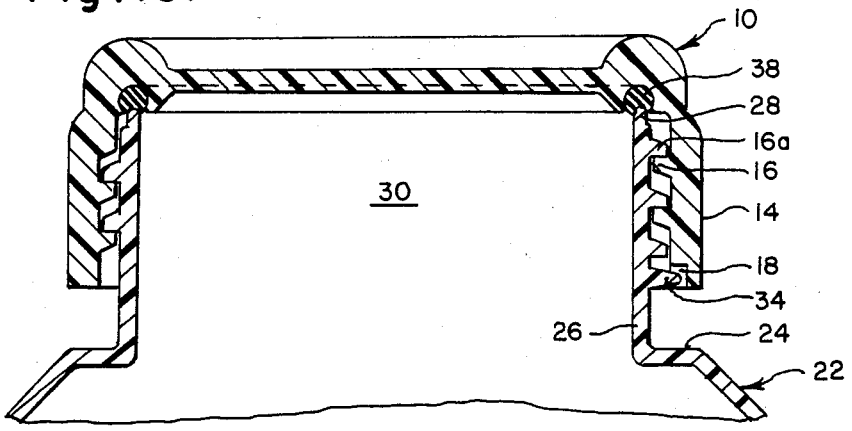
Figure 11:
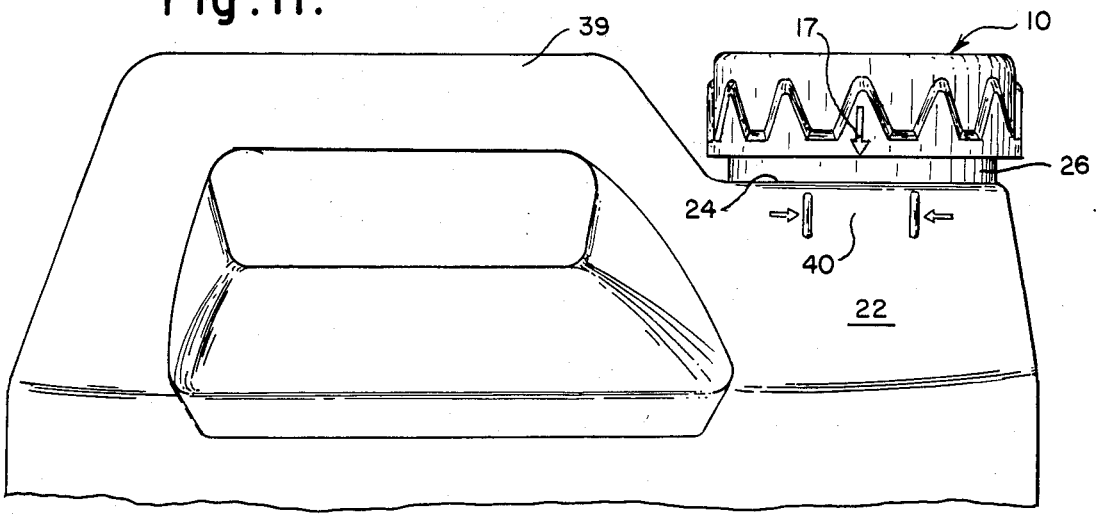
Figure 12:
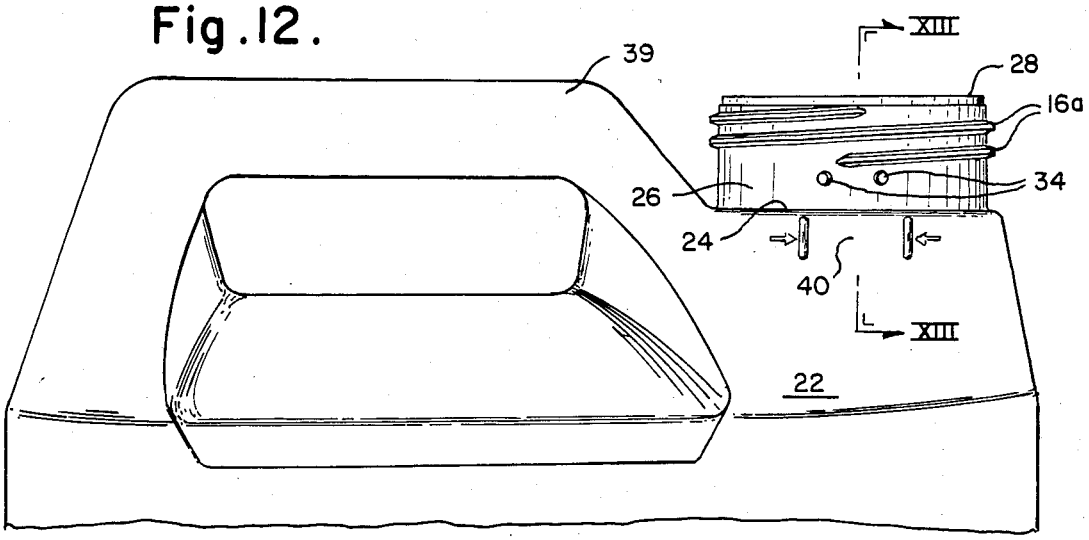
Figure 13:
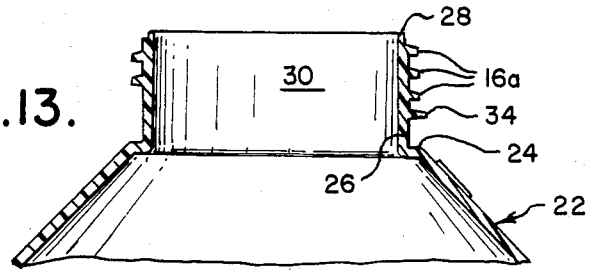
Figure 14:
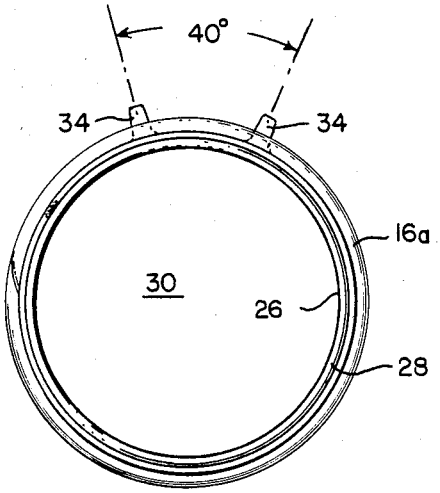
Figure 15:
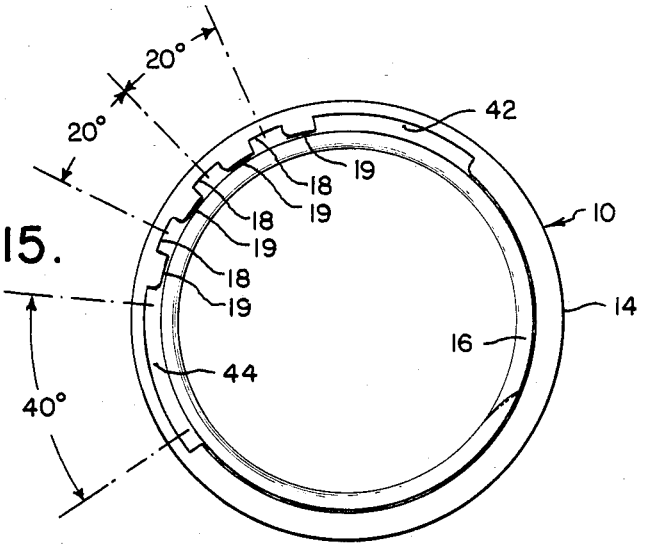
Figure 16:
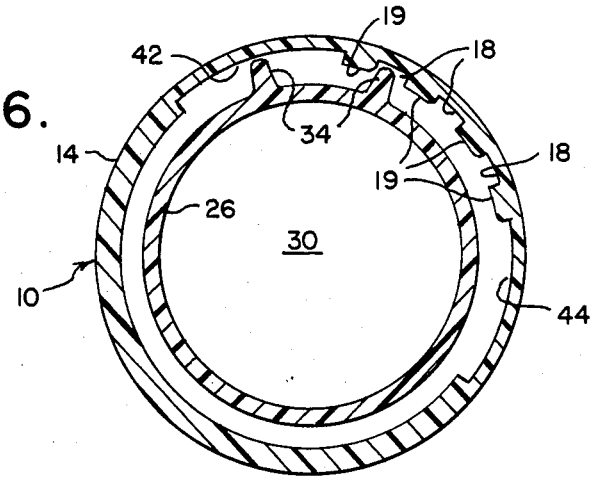

FIG. 5 is a side cross-sectional view of a combination closure means and a container neck in the sealing and child-resistant modes, FIGS. 6, 7 and 8 are side cross-sectional views of closure means-container neck combinations which illustrate the significance of the S dimension, FIG. 9 is a side cross-sectional view of a closure means-container neck combination which illustrates a stopper sealer, FIG. 10 is a side cross-sectional view of a closure means-container neck combination which illustrates an O-ring sealer, FIG. 11 shows a closure means-container combination with the markers of each in alignment, FIG. 12 is a view of a container neck having projections, FIG. 13 is a cross-sectional view of a container neck showing a projection taken on plane XIII—XIII of FIG. 12, FIG. 14 is a top view of a container neck having projections, FIG. 15 is a bottom view of a closure having groove means, and FIG. 16 is a cross-sectional view of a combination container neck and closure means illustrating the preferred child resistance mode.

Figure 1:
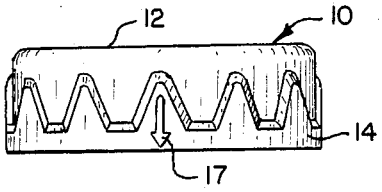
FIG. 1 is a side view of a closure means bearing a closure marker.

FIG. 1 shows a closure means 10 having a disk-shaped crown 12, a cylindrical skirt 14 and an embossed arrow-shaped closure means marker 17. Closure means 10 can be fabricated of a hard plastic material, such as polypropylene.

Figure 2:
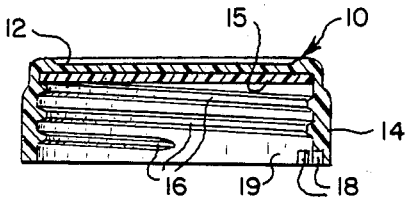
FIG. 2 is a side cross-sectional view of the closure means.
Figure 3:
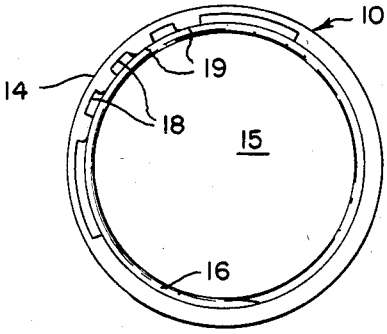
FIG. 3 is a bottom view of a closure means.

FIGS. 2 and 3 show views of the interior of the closure means including inwardly radial helical thread 16 and a plurality of grooves 18 defined by sidewalls 19 and extending around the circumference at the bottom interior of skirt 14. The interior of crown 12 is provided with a disk-shaped compressible sealer 15.

Figure 4:
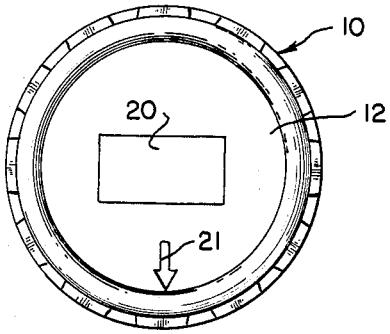
FIG. 4 is a top view of a closure means.

FIG. 4 shows the outside of disk-shaped crown 12 of closure means 10 which can have any suitably embossed inscription of directions for safe operation in the zone indicated at 20. A suitable inscription at zone 20 can read: CLOSE TIGHTLY—BE CERTAIN ARROW ON CLOSURE POINTS BETWEEN LINES ON BOTTLE. Crown 12 can also be provided with an embossed marker such as arrow 21. Arrow 21 can be positioned to come into alignment with handle 39, shown in FIGS. 11 and 12.

FIG. 5 shows closure means 10 in assembled combination with container 22. Container 22 can be a bottle having shoulder 24 protruding outwardly from neck 26. The top of neck 26 is defined by a landing 28. Neck 26 defines bottle opening or spout 30. Disk-shaped compressible sealer 15 abuts against landing 28 and is compressed thereby as indicated at 32. This compression occurs upon clockwise rotation of closure 10 and allows skirt 14 of closure 10 to descend sufficiently so that groove 18 encloses projection or lug 34 which extends radially outwardly from neck 26. Thereby, the sealing feature is achieved before the child-resistance feature, and the child-resistance feature is achieved within the zone of compression of seal 15.

FIGS. 6, 7 and 8 illustrate the "S" dimension in a container neck. The S dimension is defined as the distance from the top landing 28 of neck 26 to the uppermost extension of thread 16*a*. In FIG. 6, the S dimension is within the design of this invention. As shown in FIG. 6, landing 28 is just starting to make contact with sealer 15. At the same time, groove 18 is above projection 34 by an amount such that the available compressibility of sealer 15 upon clockwise rotation of closure 10 will allow groove 18 on closure 10 to descend into engagement with projection 34, as illustrated in FIG. 5. Therefore, FIG. 6 illustrates the combination of the invention upon rotationally entering the sealing zone during assembly and FIG. 5 illustrates the same combination of the invention upon rotationally completing the child-resistance stage of assembly.

FIG. 7 illustrates a closure-container combination in which the S dimension on the container neck is excessive for utility in this invention. As shown in FIG. 7, top landing 28 of the neck is compressed into seal 15, but the S dimension is so tall that landing 28 acts as a stop preventing groove 18 from descending into engagement with projection 34. Therefore, the embodiment of FIG. 7 cannot accomplish the child-resistance feature.

FIG. 8 illustrates a closure-container combination in which the S dimension is too small for utility in this invention. As shown in FIG. 8, the groove 18 on closure 10 does engage projection 34 to effect the child-resistance feature. However, the bottom of closure 10 is abutting against shoulder 24 of container 22, preventing closure 10 from descending further to enable top landing 28 of neck 26 from entering into sealing engagement with seal 15. Thereby, the embodiment of FIG. 8 is not an embodiment of this invention when the container is intended for a liquid.

FIGS. 9 and 10 present two other embodiments of a compressible sealing material for attachment to closure 10. FIG. 9 shows a round compressible stopper 36 which is compressed inwardly into opening 30 along the inside of top landing 28 upon rotation of closure 10 in a clockwise direction. FIG. 10 shows O-ring 38 mounted on closure 10 which is compressed into top landing 28 upon rotation of closure 10 in a clockwise direction. The embodiments of FIGS. 9 and 10 are both effective to form a fluid-tight seal. The seals of the invention can comprise rubber, plastic or any compressible material.

FIG. 11 shows the assembled combination of this invention wherein closure 10 has been rotated in a clockwise direction onto neck 26 of container 22 until the container is sealed and the child-resistance feature is engaged. Container 22 can be a one or a two and one-half gallon container having a handle 39 and used for containing agricultural chemicals. Both of these conditions being satisfied, arrow marker 17 on closure 10 is aligned with marked zone 40 on container 22. FIGS. 12 and 13 show views of container 22 with closure 10 removed, exposing the full range of thread 16*a*, the S dimension and child-resistant projections 34. Depending upon the height of grooves 18 on the closure means, projections 34 can lie on a horizontal plane, as shown, or can lie on a sloping line corresponding to threads 16*a*.

FIG. 16 illustrates the preferred child-resistance embodiment of the invention. FIG. 16 is formed by combining the closure means of FIG. 15 with the container neck of FIG. 14. Closure 10 is provided with three adjacent grooves 18 bounded by four radially inwardly extending sidewalls 19. Sidewalls 19 are curved in a cam-like manner to permit resilient, flexible, tapered and curved projections 34 to ride over them into adjacent grooves 18 upon clockwise rotation. Sidewalls 19 are not tapered in the direction of counterclockwise rotation in order to make disengagement of the closure means more difficult than engagement. Neck 26 is provided with two outwardly extending projections 34. The container can be constructed of a relatively soft and flexible plastic material, such as polyethylene, so that projections 34 can flex as they ride over sidewalls 19 during rotation of closure 10 in either direction.

Closure 10 is fabricated of a relatively more rigid plastic material, such as polypropylene.

FIG. 16 illustrates the positioning of projections 34 relative to grooves 18 upon one stage of clockwise (closing) rotation of closure 10. In FIG. 16, a first projection 34 is still engaged in a groove 18 while a second projection 34 has passed over all the sidewalls 19. Further clockwise rotation of closure means 10 will dispose both projections 34 in clearance zone 42, and the closure will be fully in the child-resistant mode.

Upon counterclockwise (opening) rotation of closure 10, each projection 34 will have to ride over the non-cam shaped edge of each sidewall 19. Closure 10 will not be entirely out of the child-resistant mode until both projections 34 are disposed in clearance zone 44 so that no projection is within a groove 18.

FIG. 16 shows that there is a gap between adjacent projections 34 in which one or more grooves 18 can reside without engaging a projection while an adjacent groove does engage a projection. This is accomplished since adjacent projections 34 are disposed about 40 degrees apart (see FIG. 14) while adjacent grooves 18 are closer together, i.e. about 20 degrees apart (see FIG. 15).

I claim:

1. A combination including a container and a removable rotatable closure means therefore that resists being unsealed and opened from a child-resistant position, said position being visually indicated during assembly of said combination, said container having a tubular neck with an exterior helical thread, a plurality of outwardly radial projections on said neck at a level below said exterior thread, said neck having a top opening, said closure means having a disk-like crown and an integral cylindrical skirt depending therefrom, said skirt having an interior helical thread for functionally engaging said exterior thread, a compressible sealing material inside said crown that cooperates with said opening for fluid-tight sealing of said opening when said closure is threadedly tightly engaged thereon, said skirt having interior groove means located below said interior thread for functionally engaging said projections, said groove means defined by spaced-apart sidewalls extending radially inwardly from said skirt, said projections and said sidewalls being shaped to allow said groove means to engage and disengage said projections upon rotation of said closure means on said thread in either direction, a closure marker on the exterior of said closure means, said groove means requiring an enhanced torque force to enable said groove means to engage and disengage said projections, said combination adapted so that upon rotating said closure means in a closing direction said compressible material contacting said opening to effect a seal and upon further rotation in a closing direction said compressible material being compressed while said groove means engage said projections, said combination adapted so that upon said further rotation said closure marker comes into visual alignment with a visible feature on said container indicating that said combination is sealed and resists being unsealed.

2. The combination of claim 1 wherein said projections are arranged along a horizontal plane.

3. The combination of claim 1 wherein said projections are arranged along a sloping line corresponding to the slope of said exterior helical thread.

4. The combination of claim 1 wherein said visible feature on said container is a container marker disposed below said projections.

5. The combination of claim 1 wherein said visible feature on said container is a container handle.

6. A combination including a container and a removable rotatable closure means therefore that resists being unsealed and opened from a child-resistant position, said child-resistant position being visually indicated during assembly of said combination, said container having a tubular neck with an exterior helical thread, a plurality of outwardly radial projections on said neck at a level below said exterior thread, said neck having a top opening, said closure means having a disk-like crown and an integral cylindrical skirt depending therefrom, said skirt having an interior helical thread for functionally engaging said exterior thread, a compressible sealing material inside said crown that cooperates with said opening for fluidtight sealing of said opening when said closure is threadedly tightly engaged thereon, said skirt having interior groove means located below said interior thread for functionally engaging said projections, said groove means defined by spaced-apart sidewalls extending radially inwardly from said skirt, said projections and said sidewalls being shaped to allow said groove means to engage and disengage said projections upon rotation of said closure means on said threads in either direction, a closure marker on the exterior of said closure means, said groove means requiring an enhanced torque to enable said groove means to engage and disengage said projections, said combination adapted so that upon rotating said closure in a clockwise direction said compressible material contacting said opening to effect a seal and upon further rotation in a clockwise direction said compressible material being compressed while said groove means engage said projections, the circumferential position of the beginning of said exterior thread on said tubular neck being related with the circumferential position of the beginning of said interior thread on said skirt so that upon said further rotation said closure marker comes into visual alignment with a visible feature on said container indicating that said combination is sealed and resists being unsealed.

7. A combination including a container and a removable rotatable closure means therefore that resists being unsealed and opened from a child-resistant position, said child-resistant position being visually indicated during assembly of said combination, said container having a tubular neck with an exterior helical thread, a plurality of outwardly radial projections on said neck at a level below said exterior thread, said neck having a top opening, said closure means having a disk-like crown and an integral cylindrical skirt depending therefrom, said skirt having an interior thread for functionally engaging said exterior thread, a compressible sealing material inside said crown that cooperates with said opening for fluidtight sealing of said opening when said closure is threadedly tightly engaged thereon, said skirt having interior groove means located below the level of said interior thread for functionally engaging said projections, said groove means defined by spaced-apart sidewalls extending radially inwardly from said skirt, said projections and said sidewalls being shaped to allow said groove means to engage and disengage said projections upon rotation of said closure means on said threads in either direction, a closure marker on the exterior of said closure means, said groove means requiring an enhanced torque to enable said groove means to engage and disengage said projections, said combination adapted so that upon rotating said closure means in a clockwise direction said compressible material contacting said opening to effect a seal and upon further rotation in a clockwise direction said compressible material being compressed while said groove means sequentially engage and disengage said projections until earlier engaged projections are left unengaged, said combination adapted so that upon said further rotation said closure marker comes into visual alignment with a visible feature on said container indicating that said combination is sealed and resists being unsealed.

8. The combination of claim 7 wherein after said further rotation at least one of said projections remains engaged.

9. The combination of claim 7 wherein said projections are spaced to provide a gap between consecutive projections in which at least one groove of said groove means can reside without engaging a projection while an adjacent groove of said groove means engages a projection.

10. The combination of claim 7 wherein said projections are spaced apart to provide a gap between consecutive projections in which a plurality of grooves of said groove means can reside without engaging a projection.

11. The combination of claim 7 wherein said projections are spaced apart to provide a gap between consecutive projections in which all of the grooves of said groove means can reside without engaging a projection.

12. The combination of claim 7 wherein after said further rotation at least one groove of said groove means is free of engagement with a projection while another groove of said groove means engages a projection.

13. The combination of claim 7 wherein after said further rotation none of said groove means remain engaged.

14. The combination of claim 7 wherein said sealing material is in the shape of a disk.

15. The combination of claim 7 wherein said compressible material is in the shape of an O-ring.

16. The combination of claim 7 wherein said compressible material is a stopper attached to said closure means and adapted for insertion into said opening.

17. The combination of claim 7 wherein said closure marker is the form of an arrow and said container marker is in the form of a zone marking.

18. A method for closing a container with a removable rotatable closure means capable of threaded engagement with the neck of said container with said closure means provided with a compressible material to form a fluid-tight seal between said closure means and the opening of said container and having inwardly radial projecting groove means for engaging outwardly radial flexible projection means on the neck of said container, said method comprising providing a closure marker on the exterior of said closure means, rotating said closure means on the neck of said container in a clockwise direction until said compressible material on said closure means contacts said opening and forms a fluid-tight seal therebetween, continuing said clockwise rotation until said groove means engages said projection means and until said closure marker is visually aligned with a visible feature on said container.

19. A method for closing a container with a removable rotatable closure means capable of threaded engagement with the neck of said container with said closure means provided with a compressible material to form a fluid-tight seal between said closure means and the opening of said container and having inwardly radial projecting groove means for engaging outwardly radial projection means on the neck of said container, said method comprising providing a closure marker on the exterior of said closure means, rotating said closure means on the neck of said container in a clockwise direction until said compressible material on said closure means contacts said opening and forms a fluid-tight seal therebetween, continuing said clockwise rotation until an initial one of the grooves on said groove means engages an initial one of said projection means, continuing said clockwise rotation until said initial one of said grooves disengages said initial one of said projection means and engages a later one of said projection means leaving said initial one of said projection means disengaged and stopping said clockwise rotation when said closure marker is visually aligned with a visible feature on said container or has passed beyond said visible feature and said initial one of said projections is disengaged.

20. The method of claim 19 wherein said rotation is stopped when said closure marker is visually aligned with a visible feature on said container and all projections engaged prior to said later projection are disengaged.

21. The method of claim 19 wherein said rotation is stopped when said closure marker is visually aligned with a visible feature on said container and all projections are disengaged.

22. The method of claim 19 wherein said visible feature is a container handle.

* * * * *